US006494756B2

(12) United States Patent
Michaud et al.

(10) Patent No.: US 6,494,756 B2
(45) Date of Patent: Dec. 17, 2002

(54) FLOATING INFLATABLE DEVICE, PARTICULARLY AN INFLATABLE LIFE RAFT, EQUIPPED WITH VENTURI INFLATION MEANS

(75) Inventors: Pascal Michaud, Chevanceaux (FR); Alain Richard, Montendre (FR); Marc Lavorata, Paris (FR)

(73) Assignee: Zodiac International S.A., Issy les Moulineaux (FR)

( * ) Notice: Subject to any disclaimer, the term of this patent is extended or adjusted under 35 U.S.C. 154(b) by 0 days.

(21) Appl. No.: 10/067,254

(22) Filed: Feb. 4, 2002

(65) Prior Publication Data

US 2002/0106949 A1 Aug. 8, 2002

(30) Foreign Application Priority Data

Feb. 6, 2001 (FR) ..... 01 01582

(51) Int. Cl.[7] ..... B63B 35/58
(52) U.S. Cl. ..... 441/41; 441/42
(58) Field of Search ..... 441/38, 40, 41, 441/42; 417/171, 184

(56) References Cited

U.S. PATENT DOCUMENTS

| | | | | | |
|---|---|---|---|---|---|
| 3,158,314 | A | | 11/1964 | Young et al. | 417/171 |
| 3,684,404 | A | | 8/1972 | Galbraith | 417/184 |
| 3,685,066 | A | * | 8/1972 | Edwards | 441/41 |
| 4,355,987 | A | * | 10/1982 | Miller | 441/41 |
| 5,284,453 | A | * | 2/1994 | Kun | 441/40 |
| 6,080,027 | A | * | 6/2000 | Rodemann | 441/38 |

* cited by examiner

*Primary Examiner*—S. Joseph Morano
*Assistant Examiner*—Lars A. Olson
(74) *Attorney, Agent, or Firm*—Dean W. Russell, Esq.; Kilpatrick Stockton LLP

(57) ABSTRACT

A floating inflatable device which is to be able to be inflated on the surface of liquid and which for this purpose comprises inflation means including an on-board source of pressurized gas, wherein said inflation means comprise a venturi supplied by said source of pressurized gas and capable of entraining ambient air which contributes to the inflating of the device, and wherein said venturi inflation means, being mounted on a wall of said device, are protected by protective means covering them in such a way as to allow ambient air to pass freely while at the same time preventing liquid from being able to gain entry to the device to any appreciable extent.

12 Claims, 6 Drawing Sheets

FLOATING INFLATABLE DEVICE, PARTICULARLY AN INFLATABLE LIFE RAFT, EQUIPPED WITH VENTURI INFLATION MEANS

CROSS-REFERENCE TO RELATED APPLICATION

This application claims priority to French Patent Application No. FR 01 01582 filed on Feb. 6, 2001, the entire contents of which are hereby incorporated by reference.

FIELD OF THE INVENTION

The present invention relates in general to improvements made to floating inflatable devices and, more specifically, although not exclusively, to those of these devices which have a large inflation volume.

DESCRIPTION OF THE PRIOR ART

Inflatable devices are inflated from a source of pressurized gas, generally consisting of one or more reservoirs or cylinders of compressed gas held on board on or in the device when the latter is self-contained.

A significant problem posed lies in the fact that the larger the size of the device, the greater its inflation volume and the more the source needs to be able to deliver a high volume of gas. This accordingly results in lengthened inflation times, something which is unacceptable when the inflatable device is an emergency device (for example a life raft) which needs to be able to be deployed as quickly as possible.

Another disadvantage due to the increase in the volume of gas needed for inflation lies in the corresponding increase in the number of gas cylinders needed for inflating the increased volumes of these large-sized devices, and therefore in the considerable increase in the weight of this equipment.

In an attempt to alleviate these last drawbacks, it would admittedly be possible to envisage the use of a gas under very high pressure which, for a given inflation volume, would allow an appreciable reduction in the number of cylinders needed, and therefore the corresponding weight. However, cylinders capable of containing a gas under very high pressure have to be mechanically very strong and, as they then have not to be excessively heavy, they have to be made of special materials. Such cylinders are therefore expensive and this solution cannot be adopted for economical reasons in the case, for example, of life preservers used at sea.

SUMMARY OF THE INVENTION

It is therefore an object of the invention to improve inflatable devices of the floating type which need to be able to be inflated on the surface of the liquid in such a way that the number of on-board cylinders intended for this inflation can be appreciably reduced in order to restrict the cost and weight of this equipment without, however, this in any way affecting the speed of inflation or the ways of packaging the device, in the deflated and folded state in a container, and without this resulting in an appreciable increase in the overall cost of the device either.

To these ends, the invention proposes a floating inflatable device which is to be able to be inflated on the surface of liquid and which for this purpose comprises inflation means including an on-board source of pressurized gas, wherein, according to the invention, said inflation means comprise a venturi supplied by said source of pressurized gas and capable of entraining ambient air which contributes to the inflating of the device, and wherein said venturi inflation means, being mounted on a wall of the said device, are protected by protective means covering them in such a way as to allow ambient air to pass freely while at the same time preventing liquid from being able to gain entry to the device to any appreciable extent.

The use of a venturi in means of inflating inflatable devices is, admittedly, already known. During inflation, the stream of pressurized gas from the source creates, at the exit of the venturi where the speed of the gas is greatly increased, a depression able to give rise to a phenomenon of ambient air being sucked in through a passage associated with the venturi. This air, entrained by the jet of gas, plays an appreciable or even predominant part in inflating the device which means that the amount of gas needed for inflating the device is greatly reduced: in this way, the desired reduction in the number of cylinders and of their weight is therefore obtained, and at the same time the rate at which the device is inflated is very appreciably increased.

However, hitherto, venturi inflation means have been used only for devices on land, or alternatively for floating devices inflated before they enter the water. By contrast, such venturi inflation means have never been employed on floating devices which are to be inflated on the surface of the liquid (the case, for example, of life rafts), because of the presence of the air passage associated with the venturi and through which the water (sea water, rain, spray) can, to a large extent, enter the interior of the device.

Furthermore, and this is a drawback which is of no lesser importance, the expansion of the gas at very high pressure during inflation is accompanied by a sharp drop in temperature leading to the formation of ice which obstructs the gas passage: inflation of the device is then interrupted. As the devices in question are, in particular, emergency devices such as life rafts, such a situation is absolutely unacceptable.

It is therefore by virtue of the additional and combined use of the protective means capable of preventing the ingress of water while at the same time allowing the circulation of ambient air that venturi inflation means can be envisaged for floating inflatable devices that need to be able to be inflated on the surface of the liquid, according to the invention.

In a preferred embodiment, it is anticipated that said protective means comprise a cowling extending over said venturi inflation means and resting on the adjacent surface of the device, and that said cowling comprises an appreciably rigid framework supporting panels respectively defining mutually offset openings and constituting at least one chicane between the outside and the venturi inflation means.

In a highly advantageous embodiment, the framework consists of pressurized inflated tubes, so that, in the situation in which the device is stored in the deflated and folded state (for example in a storage container), the framework is itself deflated and folded as is the rest of the device: this then results in no appreciable additional volume to be incorporated into the container and above all there is no rigid element likely to damage the fabric of the device.

In this case, it is advantageous for the panels to be panels of watertight fabric stretched over the framework. In a simple way, it is then possible to contrive for the panels to have a height which is shorter than that of the framework, the different thus defining said respective opening.

Also a desirable feature, the panels can be opened at least partially so as to give access to the venturi, particularly so as to allow it to be plugged at the end of inflation.

In a concrete embodiment, the framework is appreciably in the shape of a dihedron, a right-angled parallelepiped or a pyramid frustum, which leads to tubes of a simple shape which can easily inflate and which above all are simple to manufacture.

For certain applications or certain conditions of use it may be found that inflation is triggered while the device is partially or completely submerged (for example, life rafts triggered from a ship which has just gone down quickly. In order to be sure that inflation using the venturi can take place, or can at least start correctly without the ingress of water when the container is submerged, it is anticipated that the device is enclosed, in the deflated and folded state, in a watertight pouch which can be opened during inflation only when the pouch is at or above the surface of the liquid. In this case, as the inflatable device is folded up in the watertight pouch, this pouch, when inflation starts, increases in volume and drives out the water that has entered the container and thus accelerates the rising of the entity to the surface. During this phase, the venturi remains protected against any ingress of water. The container then opens only after it has reached the surface and the watertight pouch does not tear until after the container opens. During the tearing of the pouch, the means of protecting the venturi or venturis are already in place and functional.

What is more, when the device starts to inflate on the surface of the liquid, the limp fabric is level with the water surface or very slightly above it which means that the venturi, insufficiently raised, runs the risk of allowing water to enter, this being all the more true since it is necessary to wait for the entire device to have begun to take shape, and therefore to wait for a certain length of time to have elapsed, for the venturi to be raised appreciably above the water surface. To avoid this disadvantage associated with the inflation time, it is anticipated that the device comprises an interior gas-permeable buffer chamber (27) into which the venturi inflation means open, by virtue of which the buffer chamber inflates first as soon as the venturi inflation means come into operation, which means are thus raised above the liquid thereby being able to operate without the appreciable ingress of liquid. Advantageously then, the buffer chamber is equipped with at least one passage with a restriction causing the said chamber to communicate with the remainder of the interior volume of the device.

Although all the provisions of the invention can be applied to any type of floating inflatable device which needs to be able to be inflated on the surface of the liquid, a particularly advantageous application of the said provisions relates to inflatable life rafts, particularly large-sized high-capacity (for example one hundred or one hundred and fifty people) rafts which are currently under development.

BRIEF DESCRIPTION OF THE DRAWINGS

The invention will be better understood from reading the detailed description of certain embodiments which are given solely by way of nonlimiting examples. In this description, reference is made to the appended drawings, in which.

Figure 1:
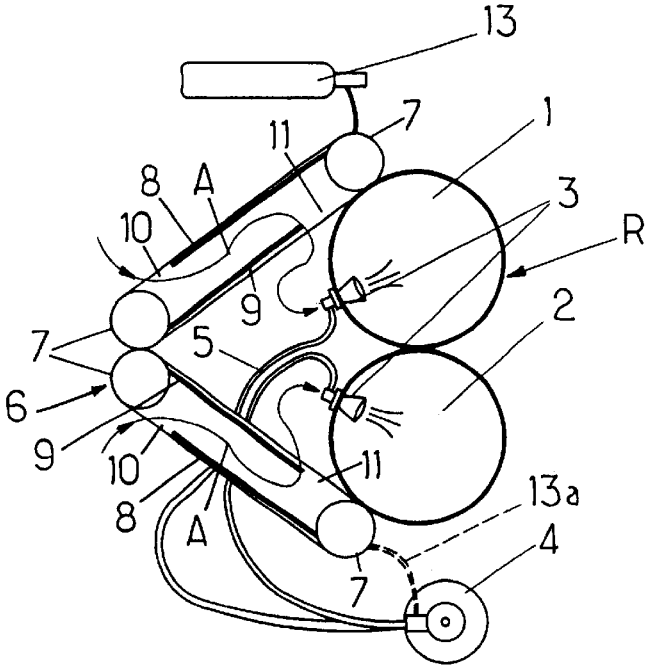
FIG. 1 is a view in cross section of part of a floating inflatable device arranged according to the invention.
Figure 2:
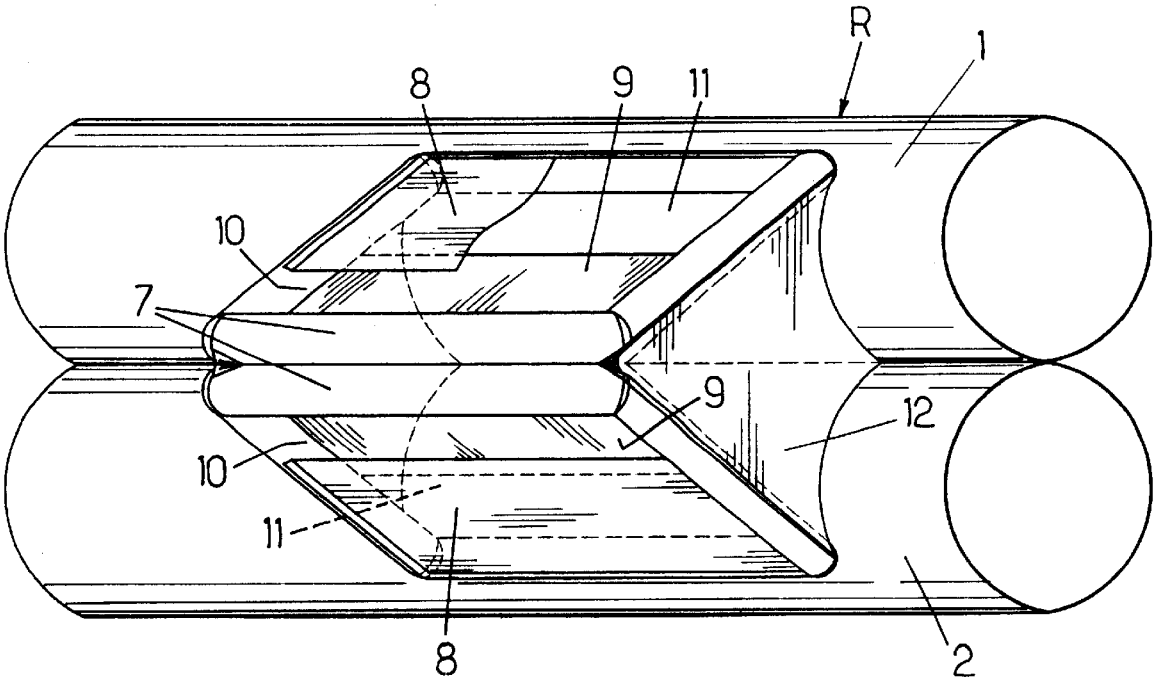
FIG. 2 is a perspective side view of the part of the said device that is illustrated in FIG. 1.

Reference is made first of all to FIGS. 1 and 2 which, in a very simplified way and in cross section, show part of a floating inflatable device R; this may, for example, be the peripheral float (consisting, for example, of two superposed tubes 1 and 2) of a life raft, the other constituent parts of which are not shown.

Each tube 1 and 2 is equipped with a venturi inflation member 3, connected by a hose 5 to a source of pressurized gas 4 consisting, in practice, of one or more gas cylinders. The source 4 may be common to all the inflation members 3 or, alternatively, the inflation members 3 are associated with separate respective sources.

To protect the venturi inflation members 3 against the ingress of water, whether this be water from the mass of liquid on which the device is floating or alternatively water in suspension in the ambient air (rain, spray), a protective structure 6 is fitted and covers the inflation member or members 3 either individually or collectively as illustrated in FIGS. 1 and 2. This protective structure is fixed to the inflatable tubes 1, 2 and forms a protective cage designed to allow ambient air (arrows A) sucked in by the venturi(s) to pass freely while at the same time preventing liquid from being entrained.

As illustrated in FIGS. 1 and 2, the protective structure 6 is in the form of a cage or cowling which rests on the tubes 1, 2, extending over the inflation means 3. This cowling comprises a rigid framework 7, for example in the form of two rectangular frames arranged as a dihedron. Each frame of the framework 7 supports panels 8, 9 which define mutually offset openings 10, 11 so as to form at least one chicane between the outside and the inflation members 3, which chicane does not impede the passage of the air (arrows A).

In the embodiment illustrated in FIGS. 1 and 2, the two frames of the rigid framework 7 have an appreciable thickness and the panels 8 and 9 are fixed to these frames on each side thereof, the outer panels 8 being mounted towards the base of the frames (the corresponding openings 10 thus being situated towards the top of the frames), while the inner panels 9 are situated towards the top of the frames (the corresponding openings 11 thus being situated towards the bottom of the frames). Such an arrangement is enough to prevent appreciable ingress of water into the venturi inflation members 3.

The protective structure 6 may give rise to numerous embodiments. However, it is desirable for it to have no rigid element which might damage, particularly tear, the fabric of the inflatable device during deployment and inflation thereof. For this reason, the rigid framework 7 consists of pressurized inflated tubes and the panels 8 and 9 are constructed in the form of panels of watertight fabric stretched over the frames, as illustrated in FIGS. 1 and 2. The end walls 12 of the cowling thus produced are formed of a fabric or flap following the exterior contour of the tubes 1, 2 and secured to the two frames of the framework 7.

This then forms a protective structure 6 which, when the framework 7 is in the deflated state, is supple and can be folded along with the device R itself when contained in its container.

To make sure that the protective structure 6 fulfils its function of protecting the venturi inflation members 3 as soon as inflation begins, it is necessary to contrive for this protective structure 6 to be inflated first, before inflation of the device begins: to this end, an independent gas source 13 (FIG. 1) may be provided and, as the volume of the gas needed for inflating the framework 6 is small, this auxiliary source 13 could consist of a small compressed-gas cylinder which would not, in terms of cost and weight, penalize the device as a whole.

By way of an alternative, it is also possible to envisage inflating the framework 6 from the main source 4, by employing sequential distribution means such that the tubes 1, 2 do not start to inflate until the framework 6 of the protective cowling has been inflated: such an arrangement is suggested in FIG. 1 by a hose 13*a* (depicted in dashed line) connecting the top of the main cylinder 4 to the framework 6.

In the example depicted in FIGS. 1 and 2, the openings 10 and 11 forming a chicane are defined by a smaller dimension (height) of the fabric panels 8, 9 compared with the corresponding dimension of the frame. Of course, other arrangements are conceivable (fabric panels with the same format as the frame and equipped with (a) hole(s), for example).

Figure 3:
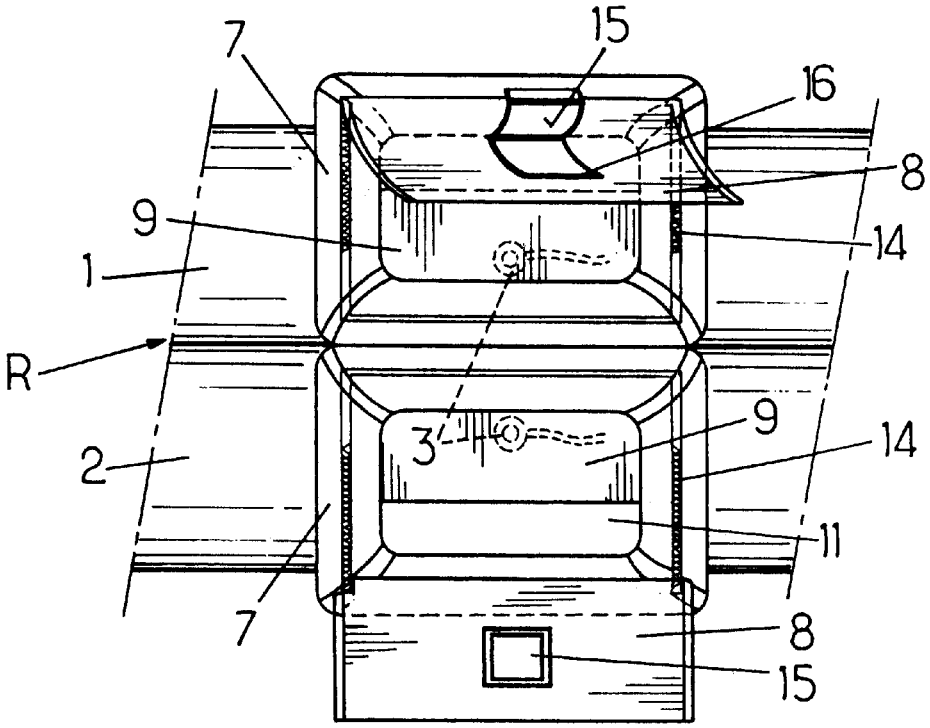
FIG. 3 is a front view of the device of FIGS. 1 and 2, shown in an alternative form.

In addition, various arrangements can be provided in conjunction with the operating requirements of the inflatable device, particularly of the venturi inflation members. Thus, it is possible to anticipate for the outer panels 8 to be fixed, to the corresponding frame of the rigid framework 7, removably (at least along their two lateral sides), using easy-to-handle means 14 of watertight attachment (for example strips of "Velcro" microhooks, zip fastener, etc). As illustrated in FIG. 3, which shows the cowling front-on, lifting the outer panels 8 gives access to the venturi inflation members 3 particularly for plugging (locking) these once inflation is finished.

In addition to the previous arrangement, or as replacement therefor, each outer panel 8 may be equipped with a flap 15 uncovering an aperture 16 giving restricted access to the inflation members 3.

Figure 4:
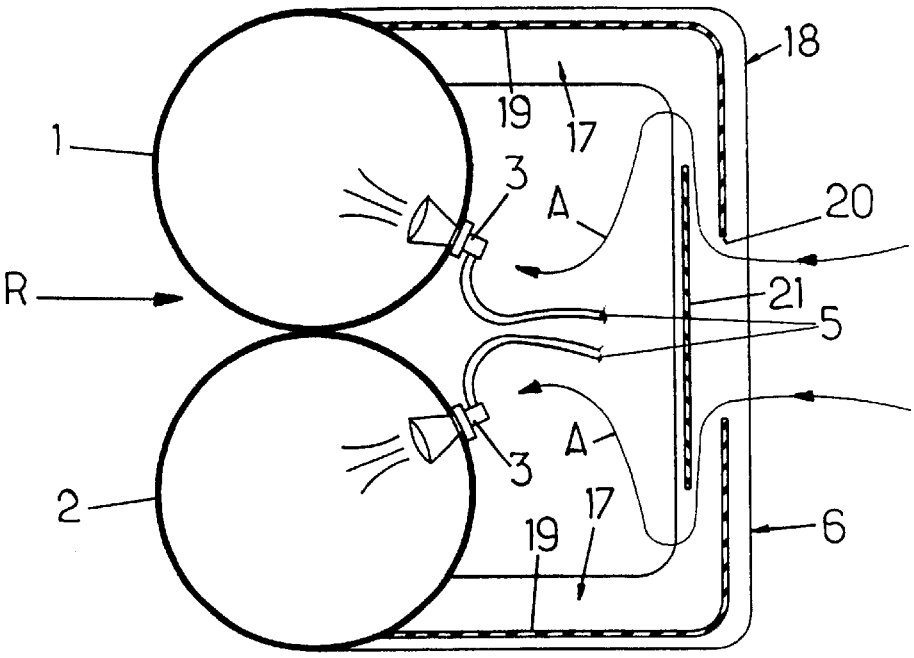
FIGS. 4 to 7 are schematic part views in cross section illustrating various alternative forms.

FIG. 4 illustrates an alternative form whereby the rigid framework 6 is no longer in the shape of a dihedron as shown in FIGS. 1 to 3, but in the shape of a right-angled parallelepiped with two appreciably parallel lateral frames 17 connected by a front frame 18. Two outer panels 19, supported by their lateral frames 17 and partially by the front frame 18 define between them, on the front frame 18, an opening 20 opposite which there lies an inner panel 21 supported at least by the front frame 18. The path taken by the air is illustrated by the arrows A.

Figure 5:
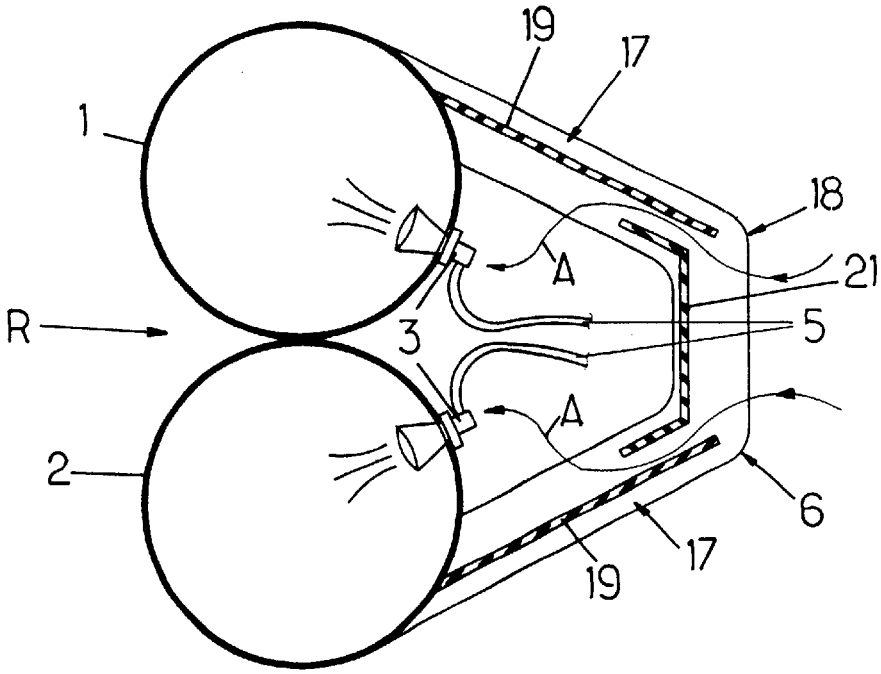

In FIG. 5, the rigid framework 6 is shaped as a pyramid frustum with the two lateral frames 17 converging towards one another. The outer panels 19 extend only along the lateral frames 17, while the inner panel 21 extends across the entire dimension of the front frame 18, turning back along the lateral frames 17 partially facing the outer panels 19.

Figure 6:
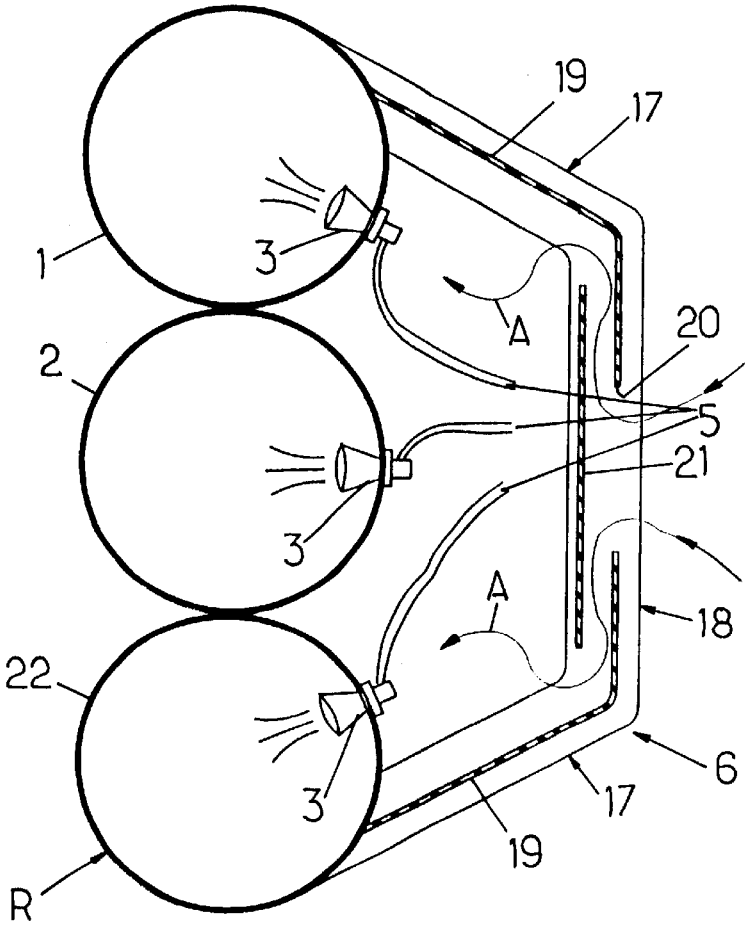
Figure 7:
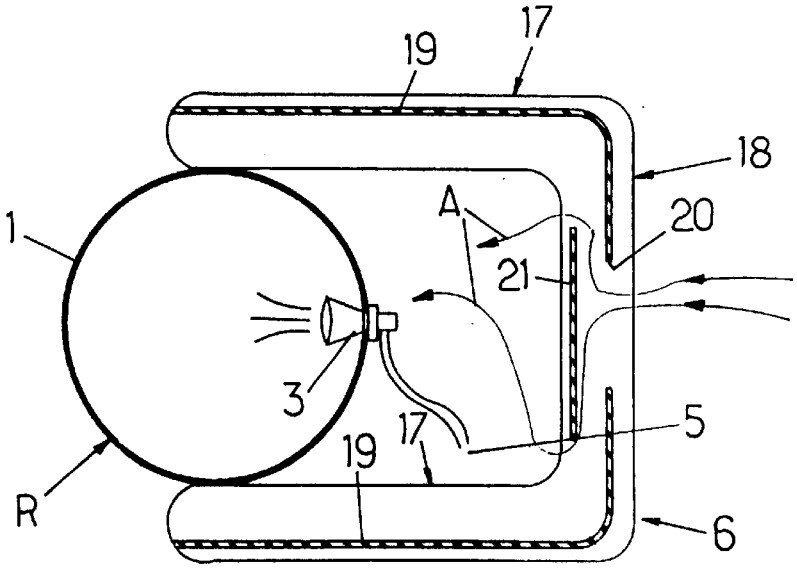

The arrangements according to the invention are not dependent on the configuration of the inflatable device R and, in particular, are not dependent on the number of tubes that make up the float. The preceding examples in FIGS. 1 to 5 have been illustrated in conjunction with a float formed as two superposed tubes 1, 2. FIG. 6 illustrates the embodiment of the cowling according to the invention, shown in FIG. 5, and associated in this case with a float formed of three superposed tubes 1, 2, 22. Likewise, FIG. 7 illustrates the embodiment of the cowling according to the invention shown in FIG. 4 but here associated with a float formed of just one tube.

In the deflated and folded state, the inflatable device can be contained in a protective shell or container. This is the case, in particular, of inflatable life rafts. However, the watertightness of the container is imperfect. As a result, water can enter the container, particularly when the latter is thrown into the water and floats for a certain length of time before inflation of the raft is initiated, or alternatively if a ship sinks quickly with the raft dragged under water before being released by a hydrostatic system triggered at a predetermined depth. Under such conditions, the ingress of water into the container may cause water to enter the raft, through the venturi inflation members.

To avoid this drawback, it is anticipated that the deflated and folded raft be contained in a watertight pouch made of a stretchy material.

Figure 8:
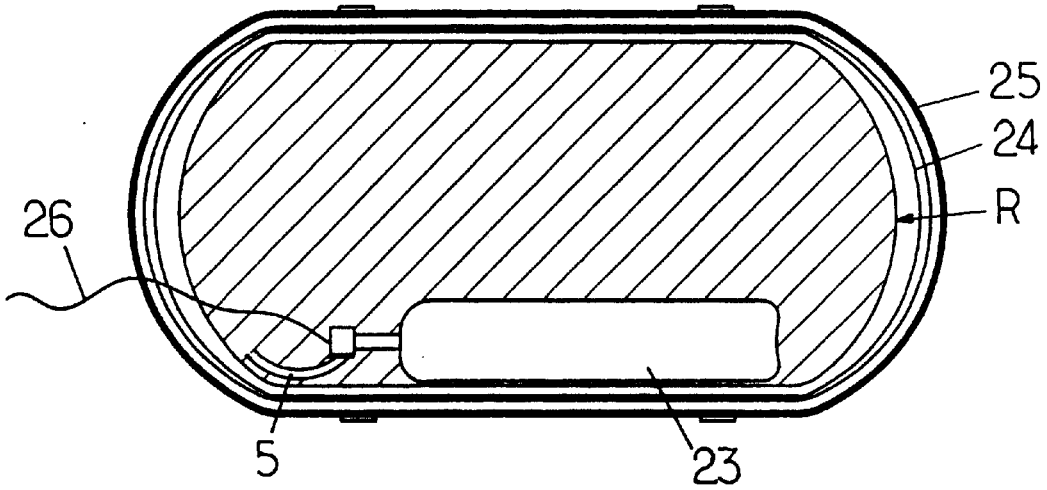
FIG. 8 As a schematic view in section of one specific implementation of a device of the invention, illustrated in the case of an inflatable life raft.

As illustrated in FIG. 8, the deflated raft R is folded, for example in such a way as to envelop the source 23 of pressurized gas needed for inflation, this source being connected by at least one hose 5 to at least one venturi inflation member (not visible). The entity is enclosed in a watertight pouch 24, which in turn is enclosed in the container 25. A line 26 for triggering the initiator of the source 23 passes through the container 25 and, in a sealed manner, through the pouch 24. It may also be connected directly to the trigger of the initiator of the source 23 if this passes in a sealed way through the pouch 24. During inflation, the pouch 24 tears under the thrust of the raft as it expands.

To improve still further the effective of the venturi inflation means arranged according to the invention, it is desirable for the inflation member or members to be pulled up above the level of the water as soon as inflation begins so as to make sure that water cannot, through the venturi or venturis, enter the inflatable device during inflation.

To this end, provision is made for the inflation gas delivered to the or each tube 1, 2 of the inflatable device to be retained, locally and temporarily, in the part of the tube 1, 2 next to the inflation member 3. Use is therefore made of a buffer chamber 27 of relatively small volume into which the inflation member 3 opens, the said buffer chamber 27 communicating with the remainder of the tube 1, 2 via a restriction which slows the flow of the gas. The result of this is that, as soon as inflation begins, the buffer chamber 27 is placed at a raised pressure and it inflates immediately, pulling the venturi inflation member up above the water and allowing it to assume its function under the best conditions.

The embodiment of the buffer chamber 27 may give rise to various alternative forms.

Figure 9A:
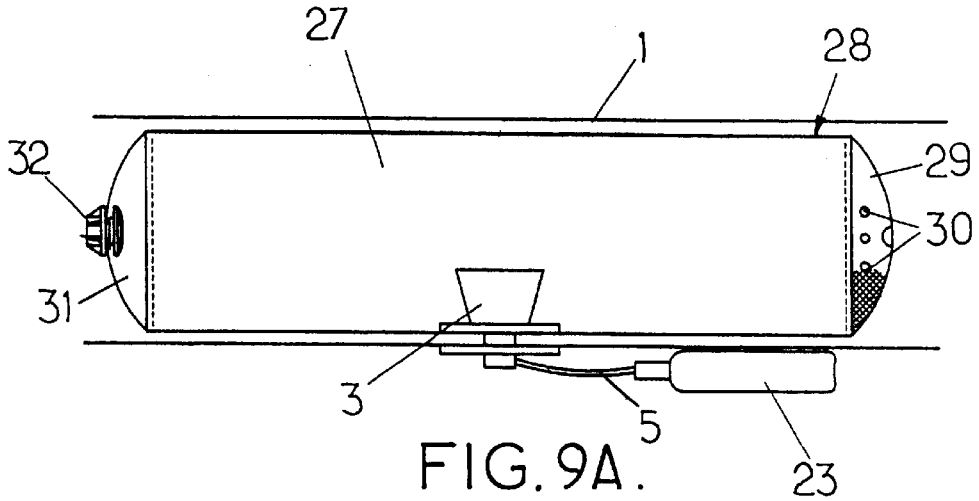
FIGS. 9A to 9C are schematic part views, in section, illustrating various alternative forms of another arrangement of the invention.

Thus, as illustrated in FIG. 9A, the buffer chamber 27 may consist of a closed chamber 28 inserted inside the tube (1 for example) and into which the venturi inflation member 3 opens, this member being connected by a hose 5 to the pressurized gas cylinder 23.

The chamber 28 has an end wall 29 which is equipped with calibrated holes 30 slowing the flow of the gas from the chamber 27 to the remainder of the tube 1. The other end wall 31 may be equipped in the same way as the wall 29 and/or may, as illustrated, be equipped with a pressure relief valve 32, by way of a safety feature.

Figure 9B:
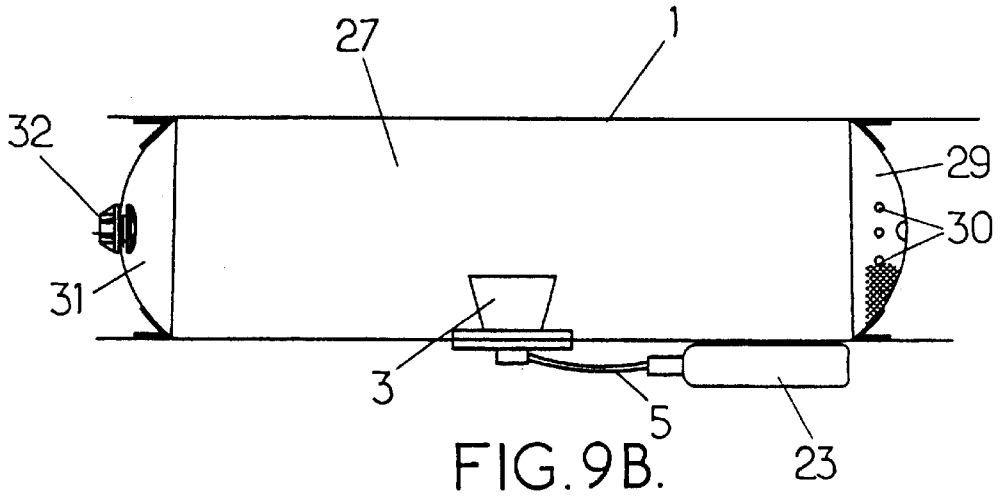

FIG. 9B illustrates an alternative form of embodiment similar to that of FIG. 9A, except that the chamber 27 is defined by a portion of the tube 1 itself which is delimited by two transverse partitions 29 and 31 secured to the wall of the tube 1 and equipped as described above with reference to FIG. 9A.

Figure 9C:
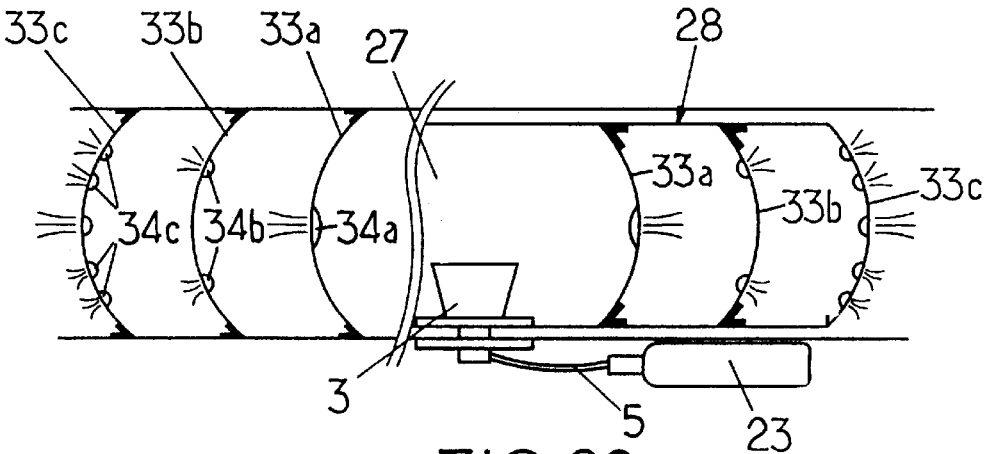

Of course, the flow of the gas may be slowed by any appropriate means such as, apart from the aforementioned calibrated holes, simply by the pressure relief valve, a porous fabric, a system of chicanes, etc. By way of example, FIG. 9C illustrates a multi-compartment arrangement with the compartment delimited by successive partitions 33*a*, 33*b*, 33*c*, etc equipped with calibrated holes 34*a*, 34*b*, 34*c*, etc respectively of increasing total cross section. The left-hand part of FIG. 9C depicts an arrangement with partitions secured to the tube 1 and the right-hand part of FIG. 9C depicts an arrangement involving an attached chamber 28 equipped with a number of successive walls.

Similarly, the transverse partitions secured to the tube may have any desired shape (spherical cup, frustoconical, etc), and likewise the chamber 28 introduced into the tube 1 may have any desired shape (cylindrical, biconical, spherical, etc).

As already mentioned above, the arrangements according to the invention find a preferred, although not exclusive, application in inflatable life rafts, particularly in high-capacity life rafts, that is to say once capable of holding a great many people (for example 100 to 150 people) and therefore having large dimensions and therefore a high inflation volume.

To provide a clearer understanding of the benefit of the arrangements explained previously, FIGS. 10A to 10C illustrate three stages in the initial phase of deployment of a life raft according to the invention.

Figure 10A:
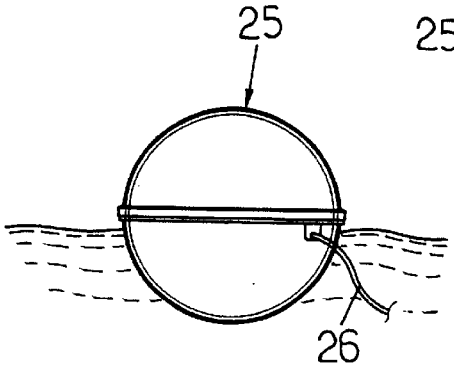
FIGS. 10A to 10C respectively illustrate three stages in the initial phase of deploying a life raft equipped according to the invention.
Figure 10B:
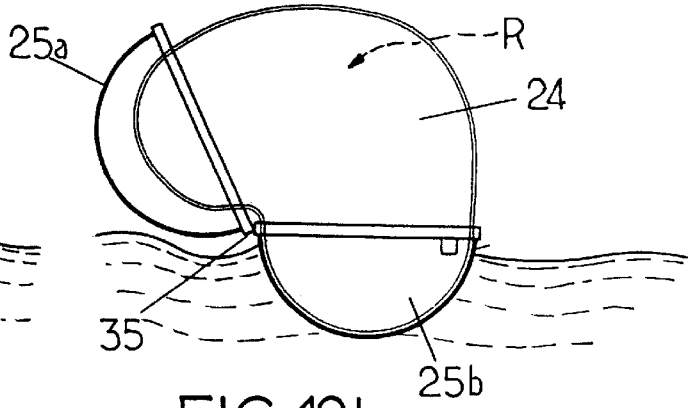

In FIG. 10A, the container 25 containing the raft has been thrown into the water and floats on the surface. The arrangement may be the one indicated above with reference to FIG. 8 and illustrated therein.

By pulling (automatically or manually) on the line 26, the initiator of the operating head of the pressurized gas cylinder 23 is triggered, and this begins the inflation process.

The two half-shells 25*a*, 25*b* of the container 25, for example hinged together about a hinge 35, separate from one another (FIG. 10B) and release the raft which begins to inflate inside the flexible watertight pouch 24. The size of the watertight pouch 24 and the coefficient of elongation of the material of which it is made are such that, under the thrust of the raft as it begins to inflate, the pouch defines a significant volume protected in a watertight way from the water. What is more, it is the buffer chambers 27 which begin to inflate, before the gas propagates into the remainder of the tubes.

Figure 10C:
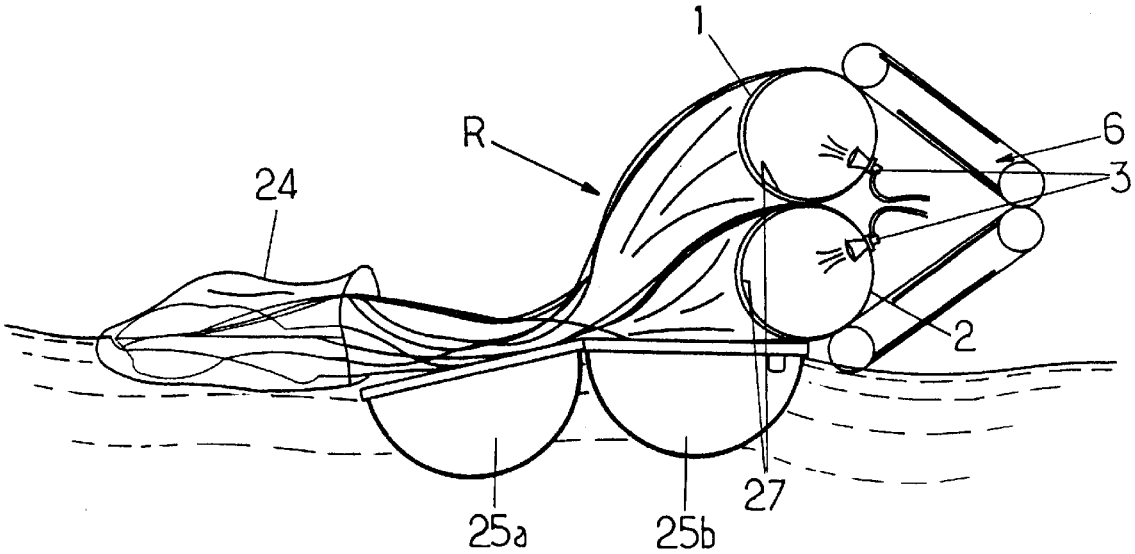

Finally, when the distended pouch 24 ends up tearing along a line which has been weakened for that purpose, the buffer chambers 27 of the tubes 1, 2 are inflated, although the remainder of the tubes 1, 2 are still in the deflated and limp state as illustrated in FIG. 10C. The buoyancy of the part of the raft associated with the venturi inflation members is great enough to hold the venturis 3 above the water and make them unable to take in water.

At that moment, the protective structure 6 is inflated and in place to protect the venturi inflation members 3: the air sucked in by the venturis is thus kept away from any contact with the water. As depicted in FIG. 10C, the half-shells 25*a*, 25*b* of the container float on the water. However, if inflation of the raft is initiated by a hydrostatic release device (in the case of a ship going down quickly in particular), the half-shells 25*a*, 25*b* may sink rapidly and the buoyancy of the structure R is afforded by the start of inflation inside the watertight pouch bringing the structure R to the surface.

The torn pouch 24 gradually releases the as yet uninflated part of the raft, which then inflates completely.

What is claimed is:

1. A floating inflatable device which is to be able to be inflated on the surface of liquid and which for this purpose comprises inflation means including an on-board source of pressurized gas, wherein the inflation means comprise a venturi supplied by said source of pressurized gas and capable of entraining ambient air which contributes to the inflating of the device, and wherein said venturi inflation means, being mounted on a wall of the said device, are protected by protective means covering them in such a way as to allow ambient air to pass freely while at the same time preventing liquid from being able to gain entry to the device to any appreciable extent.

2. Floating inflatable device according to claim 1, wherein said protective means comprise a cowling extending over said venturi inflation means and resting on an adjacent surface of the device, and wherein said cowling comprises a substantially rigid framework supporting panels respectively defining mutually offset openings and constituting at least one chicane between the outside and the venturi inflation means.

3. Floating inflatable device according to claim 2, wherein said framework consists of pressurized inflated tubes.

4. Floating inflatable device according to claim 2, wherein said panels are panels of watertight fabric stretched over the framework.

5. Floating inflatable device according to claim 2, wherein said panels have one of their dimensions shorter than the corresponding dimension of the framework, thus defining said respective opening.

6. Floating inflatable device according to claim 2, wherein said panels are arranged so as to may be at least partially opened in order to give access to the venturi, particularly so as to allow it to be plugged at the end of inflation.

7. Floating inflatable device according to claim 2, wherein said framework is substantially in the shape of a dihedron, a right-angled parallelepiped or a pyramid frustum.

8. Floating inflatable device according to claim 1, which is enclosed, in the deflated and folded state, in a watertight pouch which can be opened during inflation only when the pouch is at the surface of the liquid.

9. Floating inflatable device according to claim 1, which comprises an inner gas-permeable buffer chamber into which the venturi inflation means open, whereby said buffer chamber inflates first as soon as the venturi inflation means come into operation, which means are thus raised above the liquid thereby being able to operate without the appreciable ingress of liquid.

10. Floating inflatable device according to claim 9, wherein said buffer chamber is provided with at least one passage with a restriction causing said chamber to communicate with the remainder of the interior volume of the device.

11. Floating inflatable device according to claim 1, which is arranged as an inflatable life raft.

12. A life raft according to claim 11, which is a large-sized high-capacity raft.

* * * * *